US010882649B2

(12) United States Patent
Rauch

(10) Patent No.: US 10,882,649 B2
(45) Date of Patent: Jan. 5, 2021

(54) DRIVE UNIT FOR A STRAPPING DEVICE

(71) Applicant: FROMM HOLDING AG, Cham (CH)

(72) Inventor: Manfred Rauch, Sasbach (DE)

(73) Assignee: FROMM HOLDING AG, Cham (CH)

( * ) Notice: Subject to any disclaimer, the term of this patent is extended or adjusted under 35 U.S.C. 154(b) by 254 days.

(21) Appl. No.: 15/503,561

(22) PCT Filed: Jul. 22, 2015

(86) PCT No.: PCT/EP2015/001526
§ 371 (c)(1),
(2) Date: Feb. 13, 2017

(87) PCT Pub. No.: WO2016/023616
PCT Pub. Date: Feb. 18, 2016

(65) Prior Publication Data

US 2017/0233118 A1 Aug. 17, 2017

(30) Foreign Application Priority Data

Aug. 14, 2014 (DE) ..... 10 2014 011 929

(51) Int. Cl.
*B65B 13/02* (2006.01)
*B65B 13/32* (2006.01)
(Continued)

(52) U.S. Cl.
CPC ..... *B65B 13/025* (2013.01); *B65B 13/187* (2013.01); *B65B 13/22* (2013.01); *B65B 13/322* (2013.01); *B65B 51/222* (2013.01)

(58) Field of Classification Search
CPC ..... B65B 13/22; B65B 13/025; B65B 13/32; B65B 13/322; B65B 13/187; B65B 51/222
(Continued)

(56) References Cited

U.S. PATENT DOCUMENTS 3,823,280 A * 7/1974 Obermann ..... G04C 23/16 200/38 B
3,946,769 A 3/1976 Caveney et al.
(Continued)

FOREIGN PATENT DOCUMENTS

CH 359 405 A 12/1961
EP 0 722 885 A1 7/1996
WO WO-2009/129633 A1 10/2009

OTHER PUBLICATIONS

International Search Report issued by the European Patent Office in relation to International Patent Application No. PCT/EP2015/001526 dated Sep. 10, 2015 (3 pages) English language translation included (2 pages).

(Continued)

*Primary Examiner* — Jimmy T Nguyen
(74) *Attorney, Agent, or Firm* — Robert P. Michal, Esq.; Carter, DeLuca & Farrell LLP

(57) ABSTRACT

A drive unit for a strapping device strapping an item to be packed with a plastic tape which is laid around it includes a motorized tensioning device and a motorized welding device for the plastic tape. The tensioning and welding device can be driven by the same electric motor which can be brought alternatively into an operative connection with the devices with freewheels connected therebetween. A problem has occurred in drive units of this type that they are relatively complicated to assembly and have problematic operational reliability under certain boundary conditions. To bypass these problems, the electric motor includes at least one shell extension which protrudes beyond it at one axial end with the result that the drive elements which have up to now been mounted separately in the housing of a strapping device can be supported directly on the electric motor which then acts as a drive unit.

8 Claims, 4 Drawing Sheets

(51) Int. Cl.
*B65B 13/22* (2006.01)
*B65B 13/18* (2006.01)
*B65B 51/22* (2006.01)

(58) Field of Classification Search
USPC ..... 100/29, 32
See application file for complete search history.

(56) References Cited

U.S. PATENT DOCUMENTS

| | | | | | |
|---|---|---|---|---|---|
| 5,476,569 | A * | 12/1995 | Harada | B65B 13/322 | 100/33 PB |
| 5,690,023 | A * | 11/1997 | Stamm | B65B 13/188 | 100/29 |
| 6,244,565 | B1 * | 6/2001 | McDonnell | F02D 9/1065 | 251/129.12 |
| 8,091,473 | B2 * | 1/2012 | Kim | A47J 19/06 | 99/510 |
| 2002/0069905 | A1 * | 6/2002 | Collins | A45B 3/00 | 135/100 |

OTHER PUBLICATIONS

Written Opinion issued by the European Patent Office in relation to International Patent Application No. PCT/EP2015/001526 dated Sep. 10, 2015 (4 pages).

* cited by examiner

DRIVE UNIT FOR A STRAPPING DEVICE

CROSS-REFERENCE TO RELATED APPLICATIONS

This application is a National Phase Entry of PCT Patent Application No. PCT/EP2015/001526 filed Jul. 22, 2015, which claims the benefit of German Patent Application No. 10 2014 011 929.7, filed Aug. 14, 2014, the disclosure of each of these applications are expressly incorporated herein by reference in their entireties.

BACKGROUND

Technical Field

The present disclosure relates to a packaging components, and more particularly, to a drive unit for a strapping device for strapping a package with a plastic tape positioned around the same.

Description of Related Art

The present disclosure relates to a drive unit for a strapping device for strapping a package with a plastic tape positioned around the same, having a motor-driven tensioning device and a motor-driven welding device for the plastic tape, wherein the tensioning and welding devices can be driven by the same electric motor, which, with the interposition of freewheels, can alternately be brought into operative connection with said tensioning and welding devices.

A drive unit of this type is known and is used by the applicant in corresponding strapping devices.

The aforementioned plastic tape is first of all positioned in a loop around a package, wherein a first, free end forms a lower tape in the region of a welding device. The other end of the plastic-tape loop is guided in the form of an upper tape, together with the lower tape, through the welding device and then runs to the tensioning device. The tensioning device then contains a friction wheel, or similar element, which is driven by the electric motor. Said friction wheel, driven by the electric motor, grips the upper tape and thus pulls the loop tight around the package.

Once the plastic tape has then been wound tightly around the package, the upper and the lower tapes are pressed together in this state at the connecting location where they run through the welding device. At this location, a vibration plate, forming part of the welding device, is then lowered onto the clamped-together tapes and made to vibrate. The vibration here is generated preferably in turn by the aforementioned electric motor and, in particular, via a gear transmission. This vibration gives rise to relative movement between the upper tape and lower tape which, on account of the resulting friction, leads to the thermoweldable plastic tape melting locally. Following completion of the vibration movements and a short cooling period, the upper tape and lower tape are then in a state in which they are welded together at the connecting location.

During the vibration and/or the welding operation, the upper tape is usually cut off alongside the connecting location. Finally, the strapping device can then be removed from the package, which has the plastic tape wound around it.

As explained above, the strapping devices are now designed such that they have just one electric motor, although there are a plurality of motor-drivable subassemblies in the strapping device. This electric motor can have its drive direction reversed and is alternately brought into operative connection with the tensioning device or the welding device via freewheels which release in opposite directions. This ensures that either the tensioning device or the welding device is driven, but not both at once.

The aforementioned electric motor is designed, in particular, such that it has a motor shaft projecting out at its two (axial) ends, wherein said motor shaft has each of its ends, which project out of the electric motor, connected to one of the freewheels, which release in the opposite directions. This ensures, in principle, that the motor shaft only needs to transmit torsional moments over short distances and it can therefore be of relatively small dimensioning.

Such relatively small dimensioning, however, results in a higher risk of rupturing.

In the case of the strapping devices which have been known up until now, the electric motor—in particular a standard component and therefore a bought-in part—is mounted in unit form directly in the housing of a strapping device. Its shaft ends then fit into the aforementioned freewheels, on which, in turn, gearwheels, be these in the form of bevel gears or of spur gears, are seated. Said gearwheels have a shank or collar which is formed on in one piece and on which in each case at least one rolling-contact bearing is seated. Forces which act on the gearwheels, and act radially in relation to the axis of the motor, are thereby dissipated via said rolling-contact bearings.

The aforementioned rolling-contact bearings, as presented, for example, in WO 2009/129633, are mounted in the housing of the strapping device, but this can give rise to double fits, which can result from the mounting both of the electric motor and of the rolling-contact bearings on the housing. In order to avoid these double fits and the resulting stressing, it has been proposed that in particular the rolling-contact bearings should be mounted in rubber, this also resulting in vibrations being damped. For this mounting in rubber, use is usually made of O rings, which are positioned on the rolling-contact bearings and are available in the form of standard parts.

It has now been found, however, that, in the case of the strapping devices which have been known up until now, the electric motor used resulted in damage to the shaft ends of the electric motor or to the rolling-contact bearings with which the motor shaft is mounted in the motor housing.

It is assumed that this damage is the result of tilting moments and accompanying pitching movements which occur in the electric motor when the latter starts up, brakes or is reversed.

Therefore, there is a need to improve a drive unit like that described above to the extent where damage of the type described can be avoided.

SUMMARY

The present disclosure is directed to a drive unit for a strapping device for strapping a package with a plastic tape positioned around the same having an electric motor provided with casing extensions, which project beyond it at its axial ends.

The drive unit provided in accordance with the present disclosure has the advantage that the projecting casing extensions make it possible for the mounting of the above-mentioned gearwheels with the rolling-contact bearings seated thereon and the surrounding rubber bearings (that is to say, for example, O rings) to be separated from the housing of the strapping device and, instead, to be provided directly on the electric motor. This makes it possible to avoid relative movements between the electric motor and the rolling-contact bearings, on account of the latter being mounted separately on the housing of the strapping device.

The drive unit provided in accordance with the present disclosure also has the advantage that it is also easier to assemble the strapping device as it is being produced: whereas, up until now, a plurality of subassemblies had to be put together and inserted into the housing in order to achieve a drive unit, it is now the case that just a compact unit is inserted into the housing of the strapping device during assembly, and therefore fewer, and more straightforward, assembly steps are possible.

In order to provide for sufficient support of radially acting forces, it is proposed that the casing extension should extend axially on the electric motor provided at least in part over the freewheels, which are seated at the shaft ends of the electric motor. This means that short and direct force characteristics are possible, and the desired supporting function is therefore reliably ensured.

In embodiments, the casing extension is provided on one side with an axial fixing means, in particular an encircling outer groove. This axial fixing means allows the drive unit, which is made up of the electric motor and mounting retained therewith by the casing extension and therefore forms a compact subassembly, to be mounted precisely in the housing of the strapping device. Instead of a groove, which has production-related advantages, it is also possible to provide an annular flange or the like.

It is precisely when said axial fixing means is in the vicinity of that end of the electric motor which is provided with a bevel gear that said bevel gear can be positioned in as play-free and precise a manner as possible, and therefore the associated bevel-gear transmission operates with gear-wheels positioned as precisely as possible in relation to one another.

In order to keep the production outlay to a low level here, the casing extension, which is provided with the axial fixing means, is produced in the form of a separate component and then fitted on the casing of the electric motor. The casing of the electric motor itself can then be produced with a lesser amount of precision and therefore more cost-effectively.

In embodiments, the casing extension is formed in one piece with the cover of the motor, as a result of which it is possible to reduce the number of components which have to be produced for the drive unit.

In another embodiment, it is also possible for at least one rotation-prevention means to be incorporated in one piece in the casing extension. Hitherto conventional torque supports, which had to be fitted separately on the electric motor and possibly then required fastening in the housing of the strapping device, can therefore be dispensed with.

It should also be mentioned that designs which, at first glance, appear to be comparable but which, in contrast to the present disclosure, make use of a pneumatic motor rather than an electric motor are known.

While electric motors are produced in large numbers, and are therefore available in the form of a finished unit comprising a rotor, stator and a surrounding casing with covers, pneumatic motors are produced in a product-specific manner and, unlike electric motors, cannot be inserted for example into a divided housing; rather, they have to be inserted into joint-free accommodating bores integrated in a strapping device. The production tolerances which are inevitable here have to be compensated for by the pneumatic motor being braced axially for example via cup springs or the like, so that the sealing which is necessary for pneumatic motors is ensured. —Taking these aspects into consideration, pneumatic motors and electric motors are not comparable for the design according to the present disclosure.

BRIEF DESCRIPTION OF THE DRAWINGS

Further advantages and features of the present disclosure can be gathered from the following description of an exemplary embodiment and with reference to the drawings, wherein.

DETAILED DESCRIPTION

Figure 1:
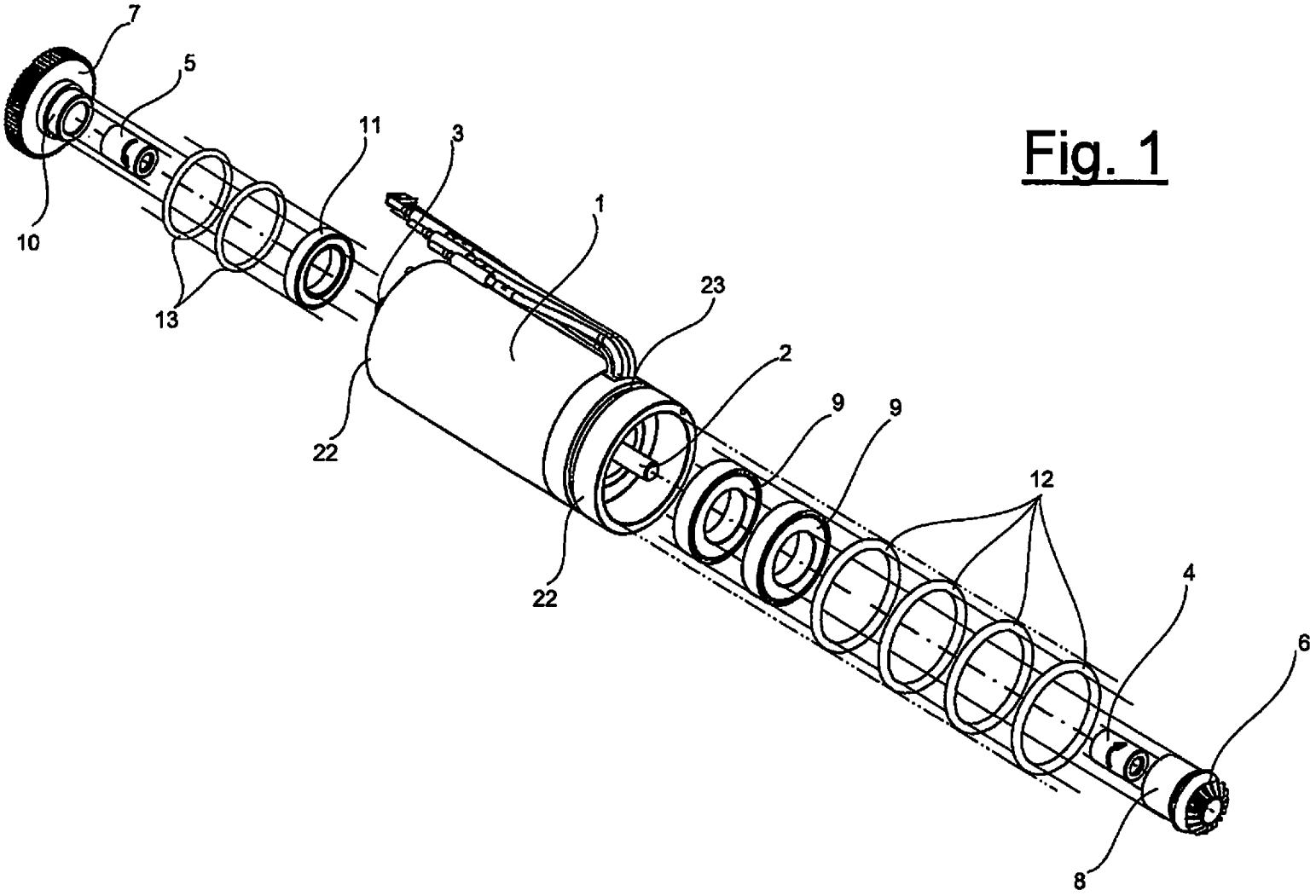
FIG. 1 shows an exploded illustration of a drive unit with a casing extension projecting beyond the electric motor at the axial ends of the latter.

The figure shows an electric motor 1, which is driven electrically via a (storage) battery (not illustrated), wherein the motor shaft, which is connected to the rotor of the electric motor, has its two ends 2, 3 projecting out at opposite ends of the electric motor 1. Seated at said shaft ends are freewheels 4, 5, which transmit a rotary movement of the shaft ends in opposite directions.

These freewheels have, on the one hand, a bevel gear 6 and, on the other hand, a spur gear 7 positioned on them.

The bevel gear 6 has a shank 8, on which two rolling-contact bearings 9 are seated. In the same way, the spur gear 7 has a collar 10, on which a rolling-contact bearing 11 is seated.

Rubber buffers in the form of O rings 12 and 13 are pushed onto the aforementioned rolling-contact bearings 9 and 11, respectively.

Figure 4:
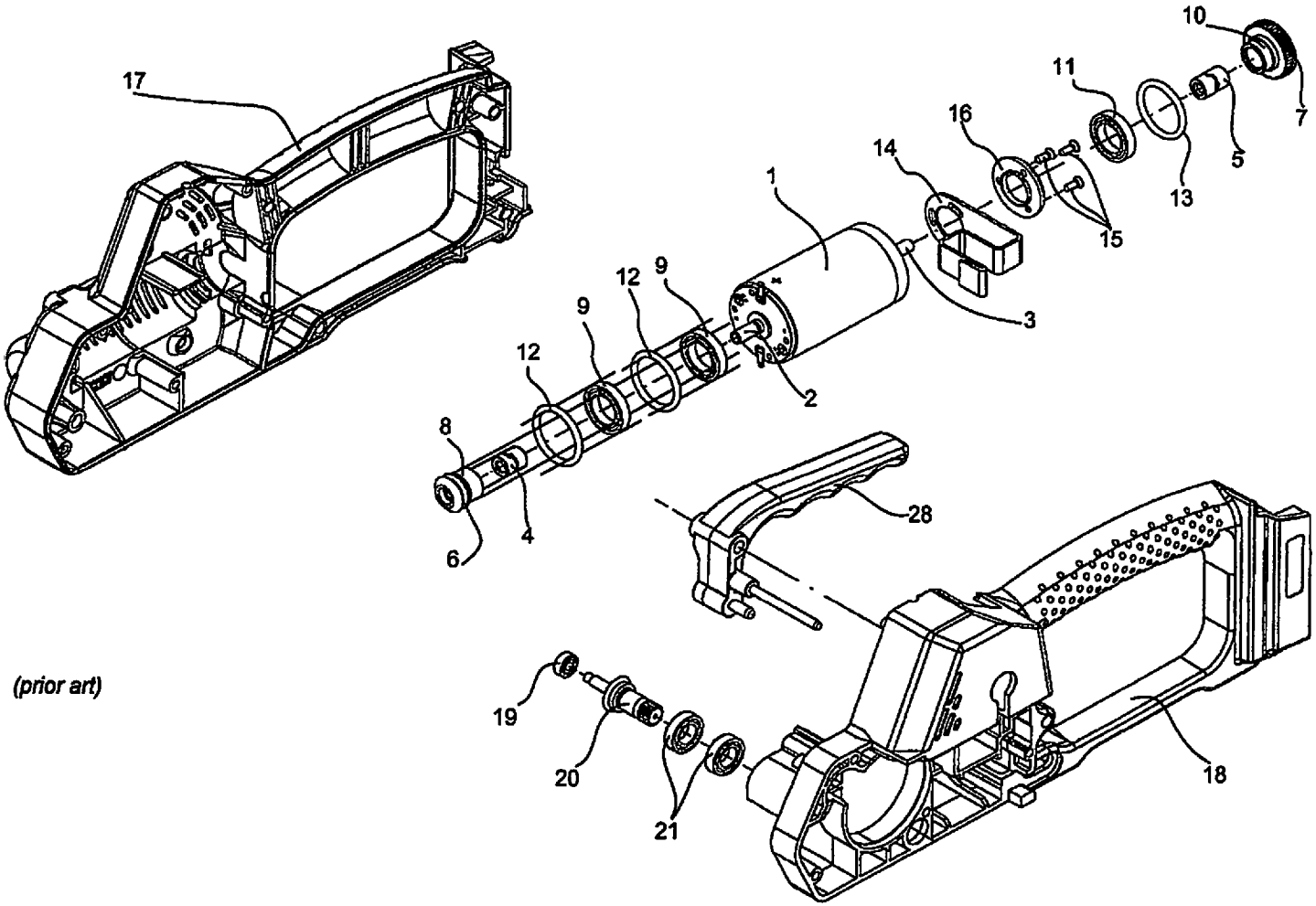
Fig. 4 (prior art)
FIG. 4 shows an exploded illustration of a prior-art drive unit for a strapping device together with parts of the housing for such a strapping device.

Also evident in FIG. 4 is a torque support 14, which is screwed firmly on the electric motor 1, via screws 15, by means of a flange disk 16.

The assembled drive unit is inserted into matching holders on housing parts 17, 18, wherein the bevel gear 6 then meshes with a mating gear 19, which is seated on a shaft 20, which is accommodated in the housing part 18 by rolling-contact bearings 21.

To give a better overview, with the exception of an actuating lever 28, the rest of the add-on parts have not been illustrated.

In the case of the strapping device, once assembled, the tensioning device (not illustrated specifically here) is opened, by actuation of the lever 28, in order for the tape to be placed in position and, once the tape has been placed appropriately in position, a pushbutton (not illustrated) is used to drive the electric motor 1 in a first direction of rotation, wherein the electric motor drives the bevel gear 6 via the freewheel 4 and therefore tensions the plastic tape which is to be welded.

When the tape is tensioned, the electric motor 1 is reversed and rotates in the opposite direction, wherein the freewheel 4 causes the gear 6 to remain in position and the freewheel 5 then drives the spur gear 7, by means of which a welding device, as described above, is driven to oscillate or vibrate.

During rotating operation of the electric motor 1, the torque of the latter is supported in relation to the housing part 18 via the torque support 14.

The above described reversal of the electric motor 1 gives rise to tilting moments which, on account of the elasticity with which the rolling-contact bearings 9 and 11 are supported in relation to the housing parts 17 and 18 via the rubber buffers or O rings 12 and 13, respectively, result in relative movements which can then ultimately lead to the shaft ends 2 or 3 being damaged.

In order to overcome this problem, a drive unit is developed as illustrated in FIG. 1. In this figure, like parts are provided with like reference signs.

It is also the case with the electric motor 1 illustrated in FIG. 1 that the shaft ends 2, 3 of the electric motor have seated on them a respective freewheel 4, 5, on which are respectively seated a bevel gear 6 and a spur gear 7. These, as described above, are provided in the same way with a shank 8 or a collar 10, on which rolling-contact bearings 9, 11 are seated.

Once again, rubber buffers in the form of O rings 12, 13 are seated on the rolling-contact bearings. In the example illustrated here, these O rings, however, are inserted into the interior of casing extensions 22, by way of which the electric motor 1 has its casing extended at its axial ends.

Figure 2:
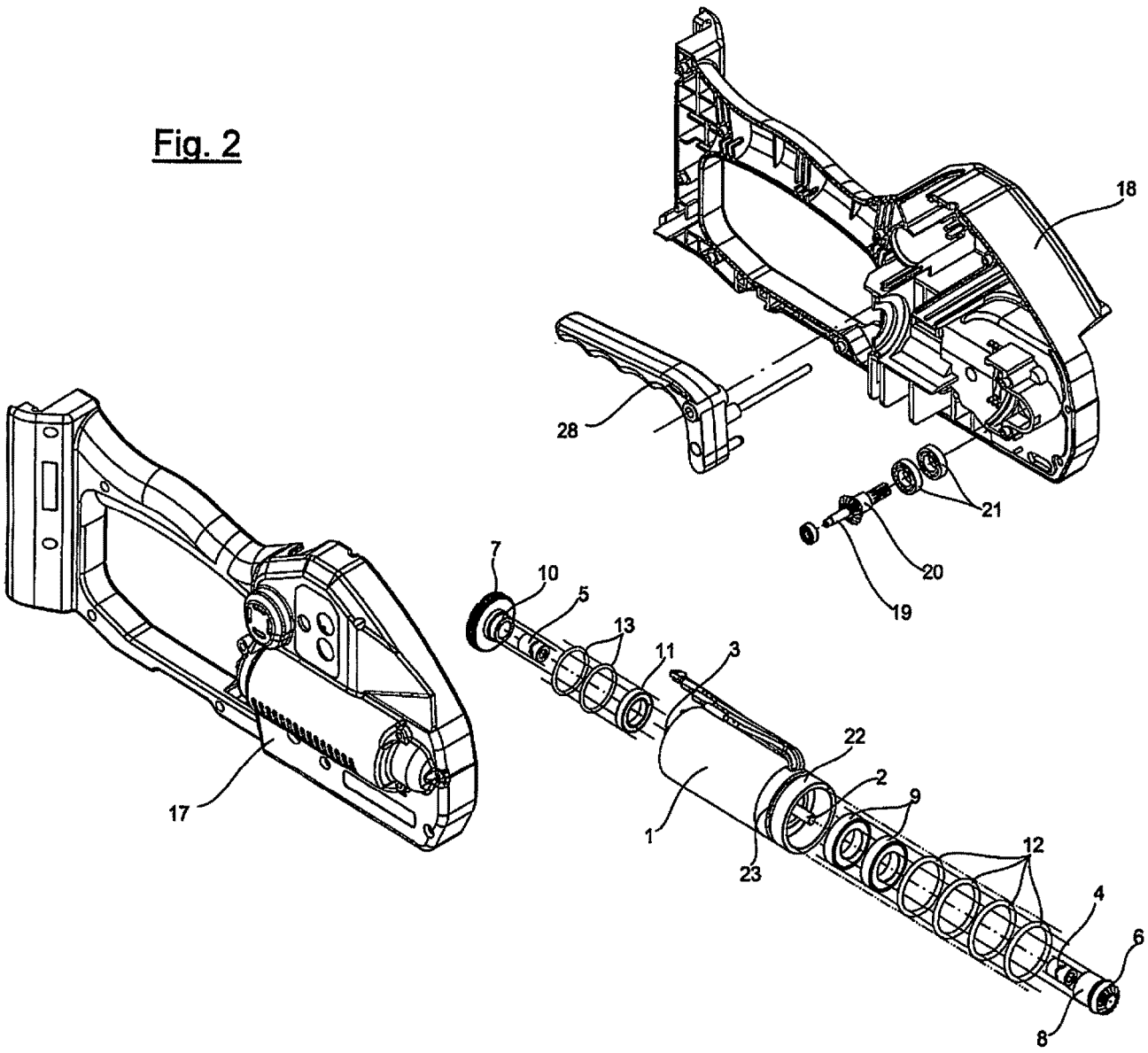
FIG. 2 shows an exploded illustration of the housing part of a strapping device with a drive unit according to FIG. 1.

Therefore, vibrations transmitted for example by the bevel gear 6 are supported in relation to the electric motor or the casing extension 22 thereof, which projects beyond the electric motor at its one axial end, via the ball bearings 9 and the O rings, and therefore the relative movement between the electric motor 1 and the support is minimized and thus cannot result in the shaft end 2 being subjected to loading. The drive unit illustrated in FIG. 1 is then inserted in the assembled state, as can be seen in FIG. 2, into appropriate housing parts 17, 18, wherein the electric motor is activated in the same way as already described above for the assembled strapping device.

Figure 3:
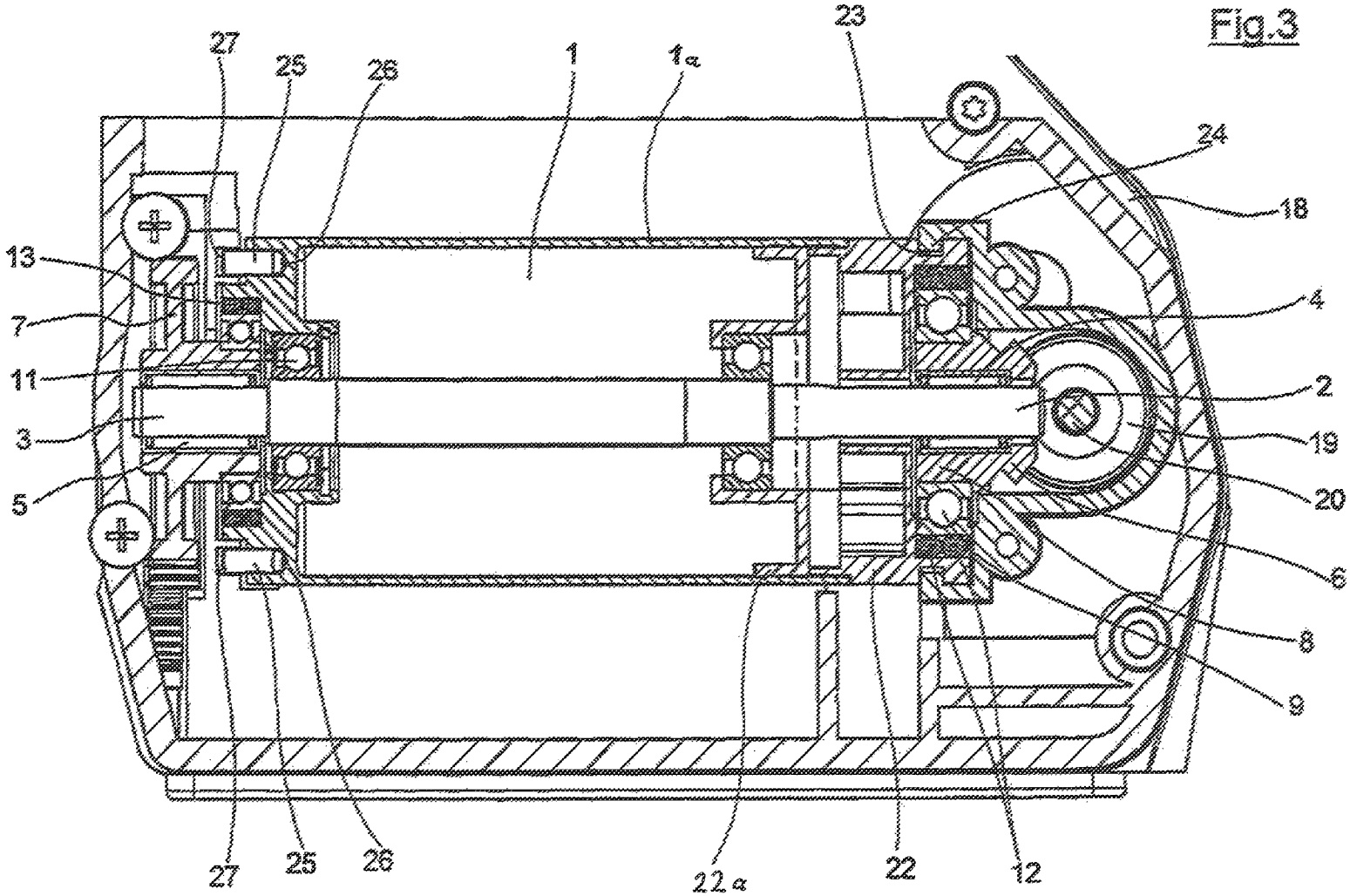
FIG. 3 shows the sectional view through a strapping device with drive unit installed.

FIG. 3 illustrates a corresponding drive unit in the installed state. It is possible to see the electric motor 1 with its shaft ends 2, 3, on which are seated the freewheels 4, 5, which then bear the bevel gear 6 and the spur gear 7, respectively. The shank 8 of the bevel gear 6 then has the rolling-contact bearing 9 seated on it, said bearing being supported in relation to the casing extension 22 via the O rings, wherein just one rolling-contact bearing 9 is provided in the example illustrated here, rather than two, as is the case in FIGS. 1 and 2. Two O rings 12 are then positioned on said rolling-contact bearing, it being possible to compensate for a double fit via said O rings 12.

In the example illustrated here, an encircling groove 23 can be seen on the casing extension 22, said groove functioning as an axial fixing means and, for this purpose, corresponding with an annular holder 24 provided on the housing part 18. The annular holder 24, as seen in the axial direction of the electric motor 1, is relatively tight up against the mating gear 19, with which the bevel gear 6 meshes, and therefore a spacing can be maintained relatively precisely here.

In order for this spacing to be established to good effect in production terms, the casing extension 22 is designed, as can be seen, in the form of a separate part and is fitted onto the casing 1*a* of the electric motor 1 having a cover 22*a*. All that is required here is for the casing extension 22 to be produced with a high level of precision, in order for it to be possible for the predetermined dimensions to be maintained precisely. The casing extension illustrated here serves, at the same time, as a cover for the electric motor, in which, in the case of the embodiment illustrated here, in particular the motor controller and a bearing for the motor shaft are also accommodated.

It should also be mentioned that it is also possible for the groove 23 to be arranged in a non-central position, as seen in relation to the casing extension, or for a flange, protrusion or the like to be provided instead.

At the opposite end, the electric motor 1 also has two pins 25 provided over its casing 1*a*. These pins engage in corresponding recesses 26, 27 on the electric motor 1 and/or on the housing 18 and therefore establish an integrated rotation-prevention means and thus a moment support for the electric motor 1. As an alternative, it is also possible for the pins 25 to be configured in the form of threaded pins and to be screwed into corresponding threaded bushings.

On account of the design explained here, the above-described drive unit according to the present disclosure can be deemed to be capable of quick and straightforward assembly and to operate very reliably during subsequent operation.

LIST OF REFERENCE SIGNS

1 Electric motor
2 Shaft end
3 Shaft end
4 Freewheel
5 Freewheel
6 Bevel gear
7 Spur gear
8 Shank
9 Rolling-contact bearing
10 Collar
11 Rolling-contact bearing
12 O ring
13 O ring
14 Torque support
15 Screws
16 Flange disk
17 Housing part
18 Housing part
19 Mating gear
20 Shaft
21 Rolling-contact bearing
22 Casing extension
23 Groove
24 Annular holder
25 Pins
26 Recess
27 Recess
28 Actuating lever

The invention claimed is:

1. A drive unit for a strapping device for strapping a package with a plastic tape positioned around the same, comprising a motor-driven tensioning device and a motor-driven welding device for the plastic tape, wherein the tensioning and welding devices can each be driven by a single electric motor having a first end portion and a second, opposite end portion, which, with interposition of freewheels, can alternately be brought into operative connection with the tensioning and welding devices, wherein the electric motor includes:

a casing extending from the first end portion;

a cover covering a front end of the casing;

a shaft end extending through the cover and forwardly from the cover; and a casing extension extending beyond the second end portion of the electric motor at an axial end thereof, wherein the casing extension is fittable in a form of a separate component on the casing of the electric motor such that the casing extension is formed in one piece with the cover of the electric motor, and wherein one of the freewheels, at least one rolling-contact bearing, and at least one O ring are disposed within the casing extension and about the shaft end, the O ring being disposed radially between the rolling-contact bearing and the casing extension.

2. The drive unit as claimed in claim 1, wherein the casing extension has at least one axial fixing component.

3. The drive unit as claimed in claim 2, wherein the axial fixing component is an outer groove.

4. The drive unit as claimed in claim 2, wherein the axial fixing component is at the second end portion of the electric motor which is provided with a bevel gear.

5. The drive unit as claimed in claim 1, wherein the casing extension is provided with at least one rotation-prevention means.

6. The drive unit as claimed in claim 1, wherein an inner surface of the casing extension forms a cavity therein adjacent the second end portion of the electric motor.

7. The drive unit as claimed in claim 1, wherein the casing extension extends contiguously with the front end of the casing.

8. The drive unit as claim in claim 7, wherein the casing extension has a rear end received within the front end of the casing and directly attached to the cover.

* * * * *